US006375384B1

(12) United States Patent
Walton et al.

(10) Patent No.: US 6,375,384 B1
(45) **Date of Patent: *Apr. 23, 2002**

(54) ISLAND FORMS

(75) Inventors: James C. Walton, Cincinnati, OH (US); William G. Prescott, Huntington Beach; Franklin E. Bessler, Westminster, both of CA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/477,500

(22) Filed: Jan. 4, 2000

Related U.S. Application Data

(63) Continuation of application No. 09/032,477, filed on Feb. 27, 1998, now Pat. No. 6,099,202.

(51) Int. Cl.[7] ..... E01C 11/22
(52) U.S. Cl. ..... 404/8; 404/7
(58) Field of Search ..... 404/7, 8

(56) References Cited

U.S. PATENT DOCUMENTS 1,141,057 A * 5/1915 Heltzel ..... 404/8
1,509,860 A * 9/1924 Cannady ..... 404/8
2,294,855 A 9/1942 Thomason
2,678,482 A 5/1954 Cuthbertson et al.
3,353,770 A 11/1967 Sondheim
3,379,105 A * 4/1968 Lynch ..... 404/8
5,058,854 A 10/1991 Bravo
5,700,106 A 12/1997 Young et al.
6,010,276 A * 1/2000 Young et al. ..... 404/8

OTHER PUBLICATIONS

OPW Fueling Components; a Dover Resources Company; *Pomeco Island Form Product Listing List Prices*; Feb. 1, 1998; pp. 1–12.
Riverside Steel, Inc.; Red–E–Form Price List. No Date.
OPW Fueling Components, *Pomeco Products*; CPOM Version 2; Apr. and May, 1997.
Formex Permanent Steel Forms; *Contractor Net Price List*; Aug. 1, 1996 and 4 photo sheets of various permanent steel forms No Date.
AM–FAB; *AM–FAB Steel Island Forms*; 1996. (11 pages).

* cited by examiner

*Primary Examiner*—Thomas B. Will
*Assistant Examiner*—Raymond W Addie
(74) *Attorney, Agent, or Firm*—Dinsmore & Shohl LLP

(57) ABSTRACT

A form for receiving a filler material to create an island is provided. The form has a substantially continuous wall having an outer surface and an inner surface. The wall has a first side and a second side opposite the first side. The inner surface forms an enclosed chamber for receiving the filler material. A first support is removably attached to the inner surface of the first side of the wall and a second support is removably attached to the inner surface of the second side of the wall. A brace is disposed between the supports, wherein the brace removably engages the supports.

19 Claims, 6 Drawing Sheets

ISLAND FORMS

RELATED U.S. APPLICATION

This application is a continuation of U.S. application Ser. No. 09/032,477 filed on Feb. 27, 1998, which is now U.S. Pat. No. 6,099,202.

TECHNICAL FIELD OF THE INVENTION

This invention relates generally to the field of forms which receive and retain liquid concrete and are used in the construction of concrete islands, and, more particularly, to forms for creating a concrete island which can accommodate cross braces for supporting a fuel dispenser sump therein.

BACKGROUND OF THE INVENTION

Forms for enclosing and constructing a concrete island are currently manufactured from a plurality of wall members which are aligned end to end so as to form an enclosure, as shown by way of example in U.S. Pat. No. 5,700,106 to Young et al. Angle iron is often welded along substantial portions of the inner surfaces of the wall members to support cross braces which extend between the wall members. The cross braces can add rigidity to the form as well as support fuel dispensing sumps or pole cribs within the form until the concrete material solidifies. In addition, angle iron is often welded on either side of the joints formed between adjacent wall members to facilitate joining the wall members together.

While these constructions may have been suitable for their intended purposes, the extensive welding utilized to attach angle iron along the length of the inner surfaces of the wall members can often warp or otherwise distort the sheet metal island forms so that labor intensive adjustment of the form at the installation site may be required. In addition, the substantial welding can add significant cost and assembly time to the manufacture of these island forms.

SUMMARY OF THE INVENTION

Accordingly, it is an object of the present invention to obviate the shortcomings of island forms.

It is another object of the present invention to provide island forms which require less welding for assembly.

It is a further object of the present invention to provide island forms which are easier and less costly to assemble.

It is still another object of the present invention to provide island forms which have simplified wall member joints.

It is still a further object of the present invention to provide island forms which permit adjustment at the installation site so as to better accommodate manufacturing, shipping, and assembly mismatches and island form distortions.

It is yet another object of the present invention to provide island forms which provide greater flexibility for the placement of cross braces within an island form without increased welding.

In accordance with one aspect of the present invention, a form for receiving a filler material to create an island is provided. The form, in it most preferred embodiment, comprises a substantially continuous wall having an outer surface and an inner surface. The wall has a first side and a second side opposite the first side. The inner surface forms an enclosed chamber for receiving the filler material. A first support is removably attached to the inner surface of the first side of the wall and a second support is removably attached to the inner surface of the second side of the wall. A brace is disposed between the supports, wherein the brace removably engages the supports.

In a preferred embodiment, the wall further comprises a first wall member and a second wall member. The first wall member and said second wall member are removably secured to each other at a first joint and a second joint. A first link spans the first joint and a second link spans the second joint, the links interconnecting the first and second wall members. A plurality of first studs can be attached to the inner surface of the wall adjacent the joints, the first studs extending radially inwardly from the inner surface and passing through apertures disposed in the link.

The wall can further comprise a plurality of second studs attached to the inner surface of the wall, the second studs extending radially inwardly from the inner surface. The supports can engage at least some of the second studs to retain the brace at a predetermined position, the brace being disposed between the second studs.

BRIEF DESCRIPTION OF THE DRAWINGS

While the specification concludes with claims particularly pointing and distinctly claiming the invention, it is believed the same will be better understood from the following description taken in conjunction with the accompanying drawings in which:

DETAILED DESCRIPTION OF THE PREFERRED EMBODIMENTS

Reference will now be made in detail to the preferred embodiments of the present invention, examples of which are illustrated in the accompanying drawings wherein like numerals indicate the same elements throughout the views. As will be understood hereafter, the most preferred embodiments of the present invention relate to improved concrete receiving forms suitable for use in constructing a concrete gasoline service station fuel island. Gasoline service station fuel islands are typically used to mount fuel dispensers, canopies, bumper guards and the like. While the present invention is described hereafter with respect to a preferred concrete receiving form for constructing a gasoline service station island, it will be understood that the present invention can be adapted for other uses and applications or configured to receive other filler materials. For example, the forms of the present invention might also be suitable for use in constructing islands for use in combination with convenience stores, banks, airports, drive-in restaurants, parking facilities and the like. These islands might contain light poles, gardens, etc. In addition, other filler materials might include soil, asphalt, slurry, plastics, building materials and the like.

Figure 1:
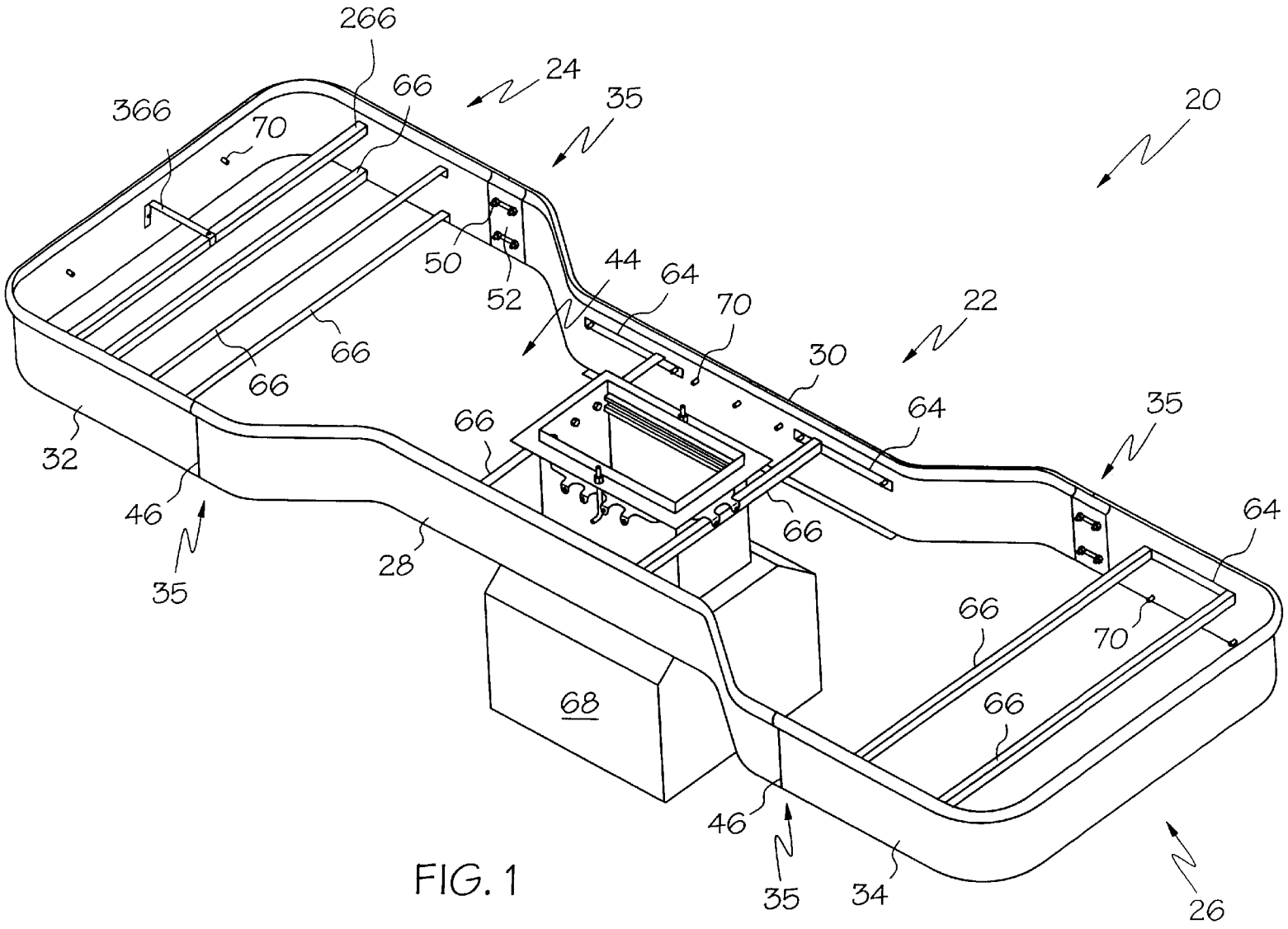
FIG. 1 is a perspective view of an island form made in accordance with the present invention.
Figure 2:
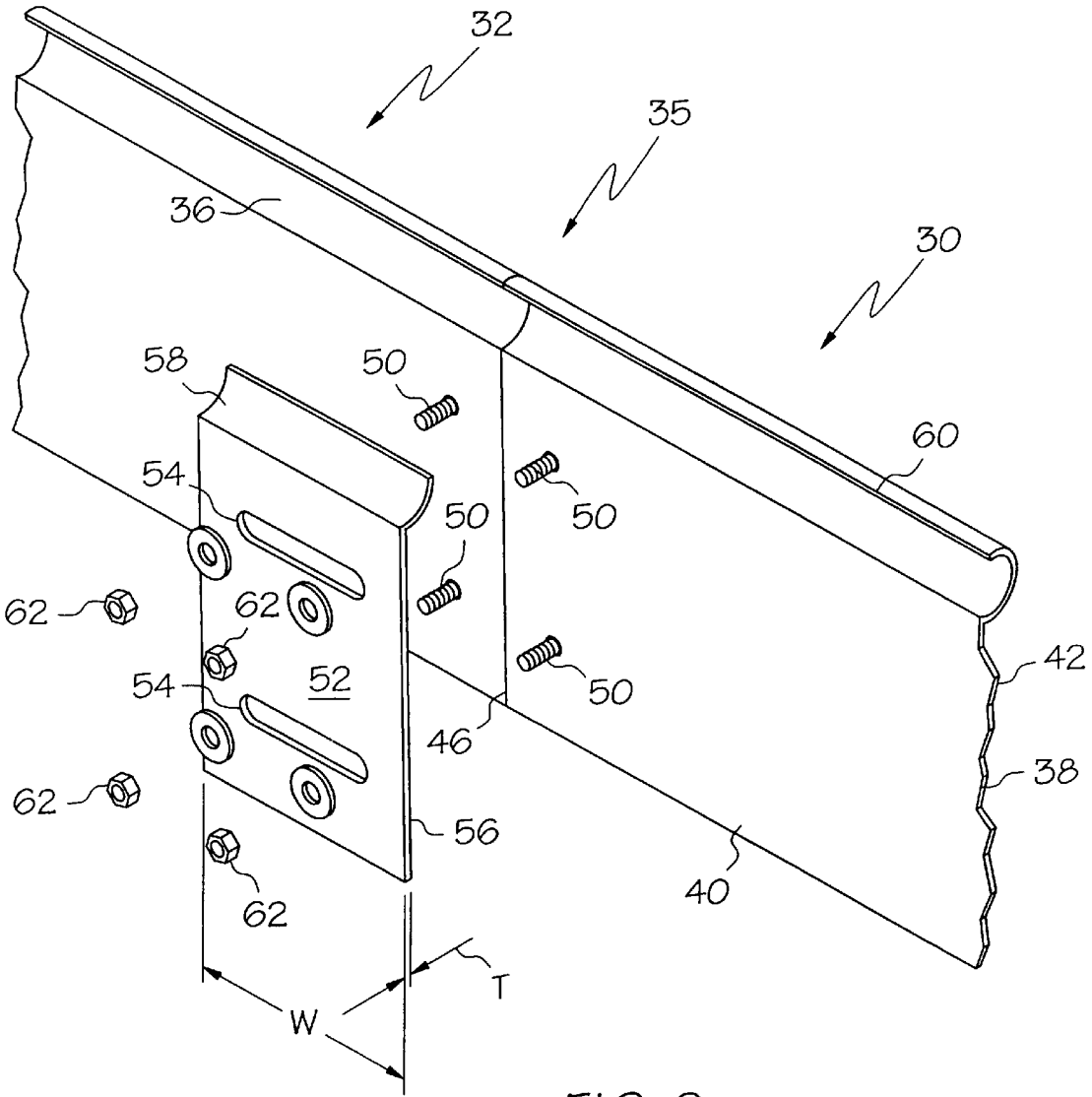
FIG. 2 is an enlarged, exploded, partial perspective view of an exemplary joint of the island form of FIG. 1.

Referring now to FIG. 1, an exemplary concrete pouring form 20 suitable for constructing a gasoline service station island is illustrated. The form 20 preferably comprises a center section 22 and two end sections 24 and 26. The center section 22 is formed by elongate wall members 28 and 30 while the end section 24 is formed by an elongate wall member 32 and the end section 26 is formed by an elongate wall member 34. Each section is interconnected to its adjacent section at a pair of joints 35. As best seen in FIG. 2, each of the wall members preferably comprises a semi-circular shaped lip 36 which extends upwardly away from a substantially planar body 38 having an inner surface 40 and an outer surface 42. The curvature of the lip 36 preferably extends beyond the outer surface 42 of the wall member so that a concrete island edge can be provided during use which has a sufficient thickness to resist breakage.

The ends of adjacent wall members (e.g., 30 and 32) preferably abut each other and are interconnected to one another to form a single substantially continuous wall, the inner surface 40 of which encloses or defines a chamber 44 (FIG. 1) for receiving and retaining the liquid concrete. As used herein, the phrase "substantially continuous wall" is intended to refer to a closed wall formed from one or more wall members, but which can contain a gap 46 at a joint 35 where the end(s) of the wall members abut and are interconnected. If the form is assembled from a single wall member, it will be understood that only a single joint 35 will be present at the location where the opposite ends of the single wall member abut and are interconnected. While the form 20 is illustrated as comprising the wall members 28, 30, 32 and 34, it is contemplated that the center section 22 and/or the end sections 24 and 26 can be formed from additional wall members as desired. In addition, while the wall members preferably abut one another and are interconnected to form a single substantially continuous wall which encloses a chamber, it is contemplated that a form made in accordance with the present invention might be discontinuous such that the end of a wall member is not interconnected to another wall member, thereby forming a large gap in the wall. In such a configuration, the ends of the unconnected wall members might abut a building or other structure so that the structure in combination with the wallmembers define a chamber for receiving and retaining liquid concrete.

Each wall member 28, 30, 32, and 34 is preferably roll formed from sheet metal, as known in the art. More preferably, the wall members are roll formed from 12 or 14 gauge steel which can be coated with a primer or galvanized. The wall members may be straight, curved or any combination thereof so that the form 20 can be provided in various shapes, sizes and configurations, depending upon the type of island to be formed and its intended use. For example, the exemplary form 20 is illustrated as having a bowtie shape when viewed from above, this shape being suitable to accommodate a single dispenser sump. However, the wall members can also be shaped and assembled so that the form 20 has a dog bone or hourglass shape to accommodate bumper guards, a substantially rectangular shape, a rectangular shape with semicircular end sections, square, oval or the like.

As best seen in FIG. 2 and in accordance with one aspect of the present invention, the exemplary joint 35, whereat adjacent wall members 30 and 32 abut and are interconnected, will now be described in greater detail. The joint 35 is preferably formed using a plurality of vertically and horizontally aligned threaded studs 50 which are disposed adjacent the ends of their respective wall members and which extend radially inwardly away from the inner surface 40 of each wall member. A link 52 having a plurality of apertures 54 spans at least a portion of the ends of the wall members 30 and 32, including any gap 46 of the joint 35, so that the link 52 can engage the studs 50 during use. The link 52 is preferably provided in the form of a substantially flat plate, and, more preferably, the outer surface 56 of the link 52 has substantially the same contour as the inner surfaces 40 of the wall members 30 and 32, as shown, so that the joint 35 can be most easily assembled and aligned. Particularly, a link 52 having a quarter circular lip 58 whose contour matches at least a portion of the lip 36 of the wall members 30 and 32 can assist in vertically aligning these wall members so that the top edge 60 of the lips 36 of the wall members 30 and 32 are substantially planar (i.e., no steps between the wall members). The threaded studs 50 pass through the apertures 54 and engage a plurality of corresponding nuts 62 which can be tightened to removably interconnect the wall members 30 and 32 and the link 52. The apertures 54 are preferably provided in the form of elongate slots, as shown, although discrete holes corresponding to the mating studs 50 can also be provided.

As will be appreciated, the combination of the studs 50 which project radially inwardly from the inner surface of the wall members, (i.e., substantially perpendicular to the inner surface of the wall members) and the link 52 which spans portions of the ends of the wall members can provide a joint 35 having increased strength while reducing the amount of labor intensive welding which is required to assemble the joint. Particularly, the flexure of the joint 35 when the form 20 is filled with liquid concrete can be reduced as the width W and the thickness T of the link 52 increases. In addition, this arrangement of the link 52 and the studs 50 can provide a joint 35 which can be adjusted during installation to accommodate distortions of the wall members which might result during manufacturing, shipping, or assembly of the form 20. For example, the width of the gap 46 at the joint 35 can be varied to accommodate manufacturing tolerances or distortions between the wall members so that the form 20 is substantially symmetrical and aligned while still providing a secure joint wherein the adjacent wall members are fixedly interconnected with each other. If the form 20 does have a gap 46 therein, it can be filled with a resin or other suitable seam bonding or filling material, if desired, to prevent the flow of liquid concrete therethrough during use. While it is preferred that the studs 50 are horizontally and vertically aligned with one another as shown in FIG. 2, it is contemplated that the studs 50 can also be offset from one another. The studs 50 can be attached to a wall member by a welding process, such as induction welding, spot welding, and the like. Alternatively, it is contemplated that bolts can be used in place of the studs 50, where the bolt head would be disposed adjacent the outer surface 42 of a wall member with the shank of the bolt passing through corresponding holes in the wall member.

Figure 3:
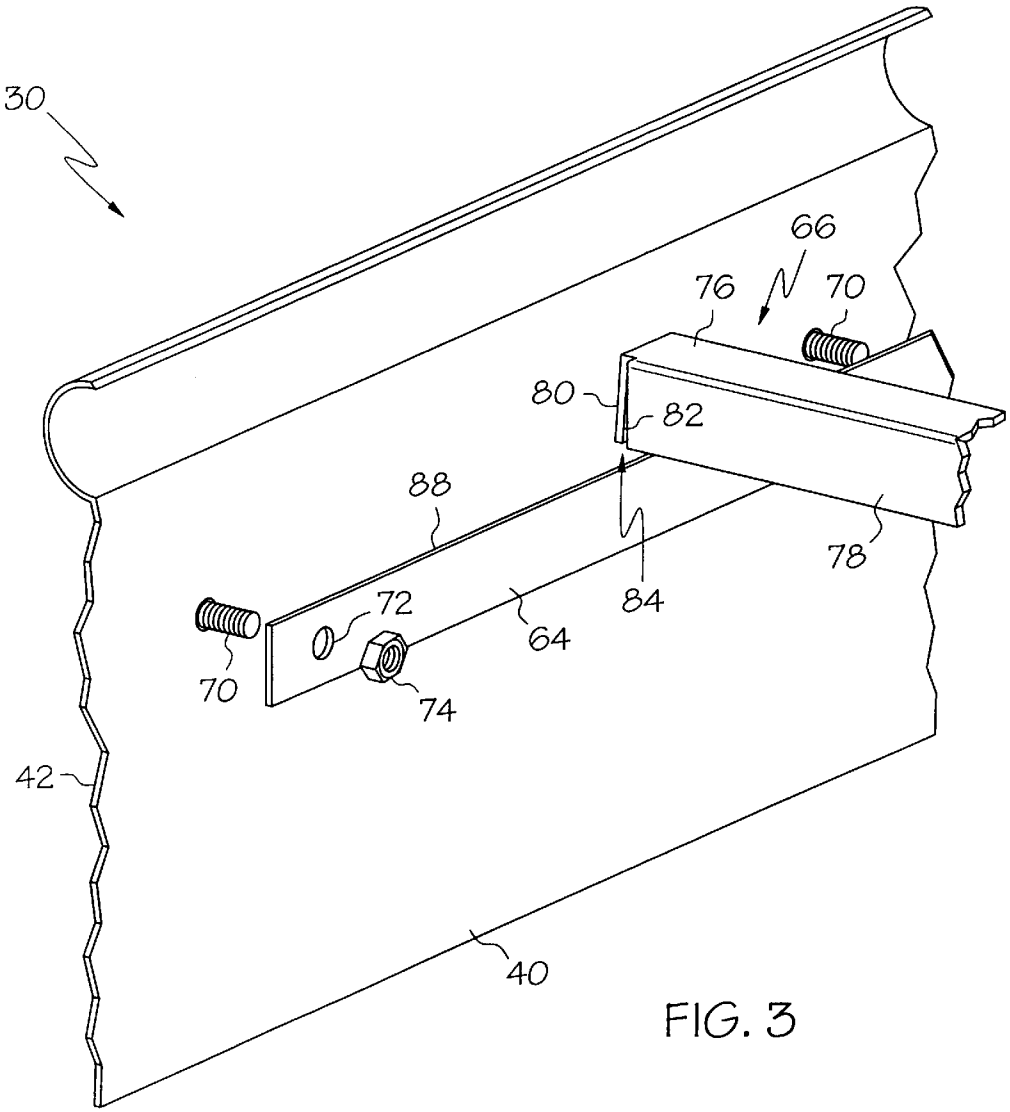
FIG. 3 is an enlarged, exploded, partial perspective view of an exemplary support and cross brace configuration of the island form of FIG. 1.
Figure 4:
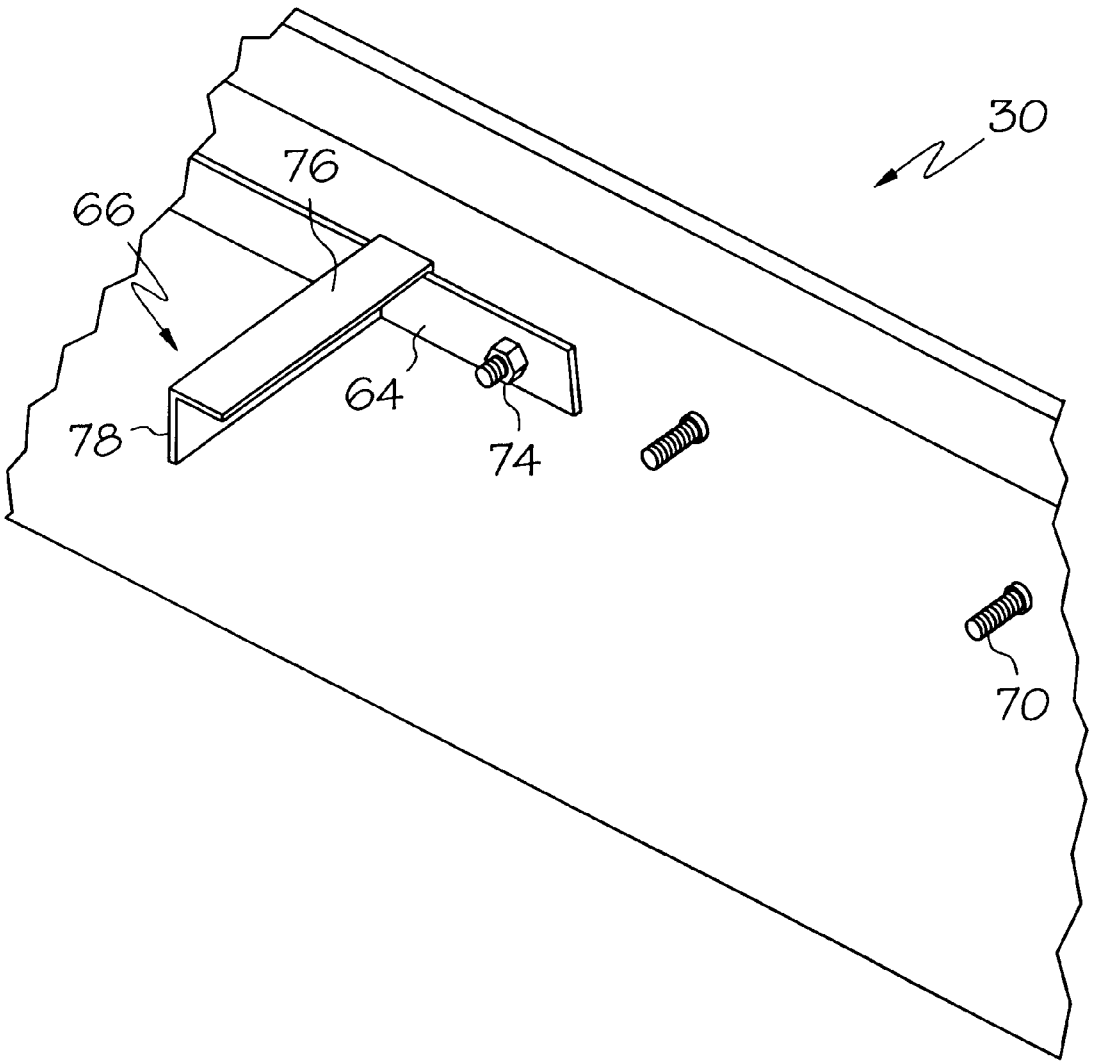
FIG. 4 is an enlarged partial perspective view of the exemplary support and cross brace configuration of FIG. 3.

Referring to FIGS. 3 and 4 and in accordance with another aspect of the present invention, an exemplary support 64 and cross brace 66 are illustrated and will now be described. Generally, the cross braces 66 can be used to support the dispenser sump 68 or can be merely used to add rigidity to the form 20. Cross braces 66 can be mounted either directly to one of a plurality of studs 70 or can be mounted using the support bar 64. The plurality of studs 70 are aligned horizontally in row-like fashion along at least a portion of the length of the wall members for attachment of support 64 and/or a cross brace 66. The studs 70 extend radially inward from the inner surface 40 of the wall members. For example, as best seen in FIG. 1, exemplary studs 70 are disposed along the elongate length of the wall members 30, 32 and 34. The studs 70 can be placed adjacent the lip 36 of a wall member, adjacent the bottom edge of a wall member or anywhere therebetween, depending upon the required position of the cross braces 66 for rigidity and/or placement of a dispenser sump 68 within a form 20. More preferably, the studs 70 are spaced at an appropriate interval between one another so as that cross braces can be attached to provide the appropriate rigidity.

As best seen in FIG. 3, the exemplary support 64 is preferably provided in the form of a substantially rectangular and flat plate having a plurality of holes 72 which correspond and mate with at least two of the studs 70. The threaded studs 70 pass through the holes 72 of the support 64 and a plurality of nuts 74 threadably engage the studs 70 to secure the support 64 against the inner surface 40 of the wall member. The studs 70 are preferably attached to a wall member in the same manner as previously described with respect to the studs 50.

The cross brace 66 is preferably provided in an elongate form comprising a top wall 76, a side wall 78 and end walls 80, wherein the side wall 78 depends downwardly from the top wall 76 such that the cross brace 66 has a substantially L-shaped cross section. More preferably, the end walls 80 are offset from the edge 82 of the side wall 78 so that a gap or notch 84 is formed between the end wall 80 and the edge 82 of the side wall 78. Most preferably, the end walls 74 are also provided with a hole 86 (FIG. 5) which is sized to accommodate passage of the studs 64 therethrough.

The cross braces 66 can be secured to the supports 64 by sliding the support 64 into the notch 84 of a cross brace 66, as shown in FIG. 4, prior to tightening the nuts 74. After the top wall 76 of a cross brace 66 engages the top edge 88 of a support 64, the nuts 64 can be tightened so that the support 74 compressingly engages at least a portion of the inner surface 40 of the wall member. As will be understood, the end wall 80 of a cross brace 66 will be disposed between the inner surface 40 of a wall member (e.g., 32) and the support 64 so that the cross brace 66 will be secured at its predetermined position along wall member. Because a cross brace can be placed anywhere along the length of a support 64, this configuration can provide greater flexibility in the corresponding placement of the cross braces along a wall member since the location of the cross brace is not limited to the specific location of the studs 70. In addition, the above-described configuration permits the removable attachment of the cross braces 66 to the form 20 without the need for a separate fastener between a support 64 and a cross brace 66. In other words, the studs 70 and nuts 74 provide for the removable attachment of both the supports 64 and the cross braces 66 to the form 20. While the cross braces 66 are illustrated as each having substantially the same shape and size, it is contemplated that the size of the cross braces can be varied depending upon whether the cross brace is supporting a dispenser sump or merely adding rigidity to the form 20. For example, the side wall 78 of a cross brace supporting a dispenser sump might have an increased height to resist bending due to the weight of the dispenser sump. As shown in FIG. 1, the supports 64 can be placed anywhere along one or more wall members where it is desired to provide flexibility in the mounting of the cross braces 66. In addition, it is contemplated that the length of the supports 64 can be increased so that a support 64 engages more than two studs 70.

Figure 5:
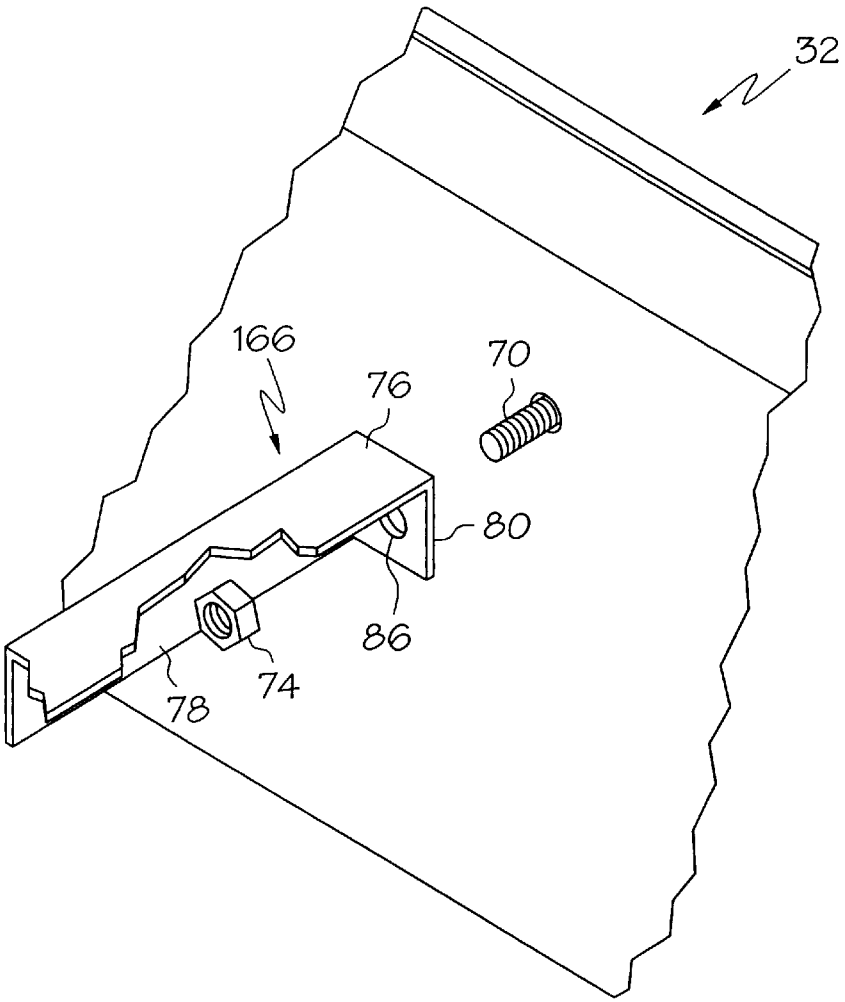
FIG. 5 is an enlarged, exploded, partial perspective view of an exemplary cross brace and stud configuration of the island form of FIG. 1.

Cross braces 66 can also be directly secured to a stud 70 by passing the shank of the stud 70 through the hole 86 of the end wall 80 of a cross brace 66, as shown by way of example in FIG. 5. In this manner, cross braces can be directly attached to a stud 70 of a wall member without the need for a support 64 or extensive welding. The same cross brace 66 can also be secured to one of the studs 50 at a joint 35 if the studs 50 have substantially the same diameter as the studs 70, as is preferred. Such a cross brace 66 attached directly one of the studs 50 can also advantageously add rigidity to the form 20 at the joint 35 and/or be used to support a dispenser sump.

Figure 6:
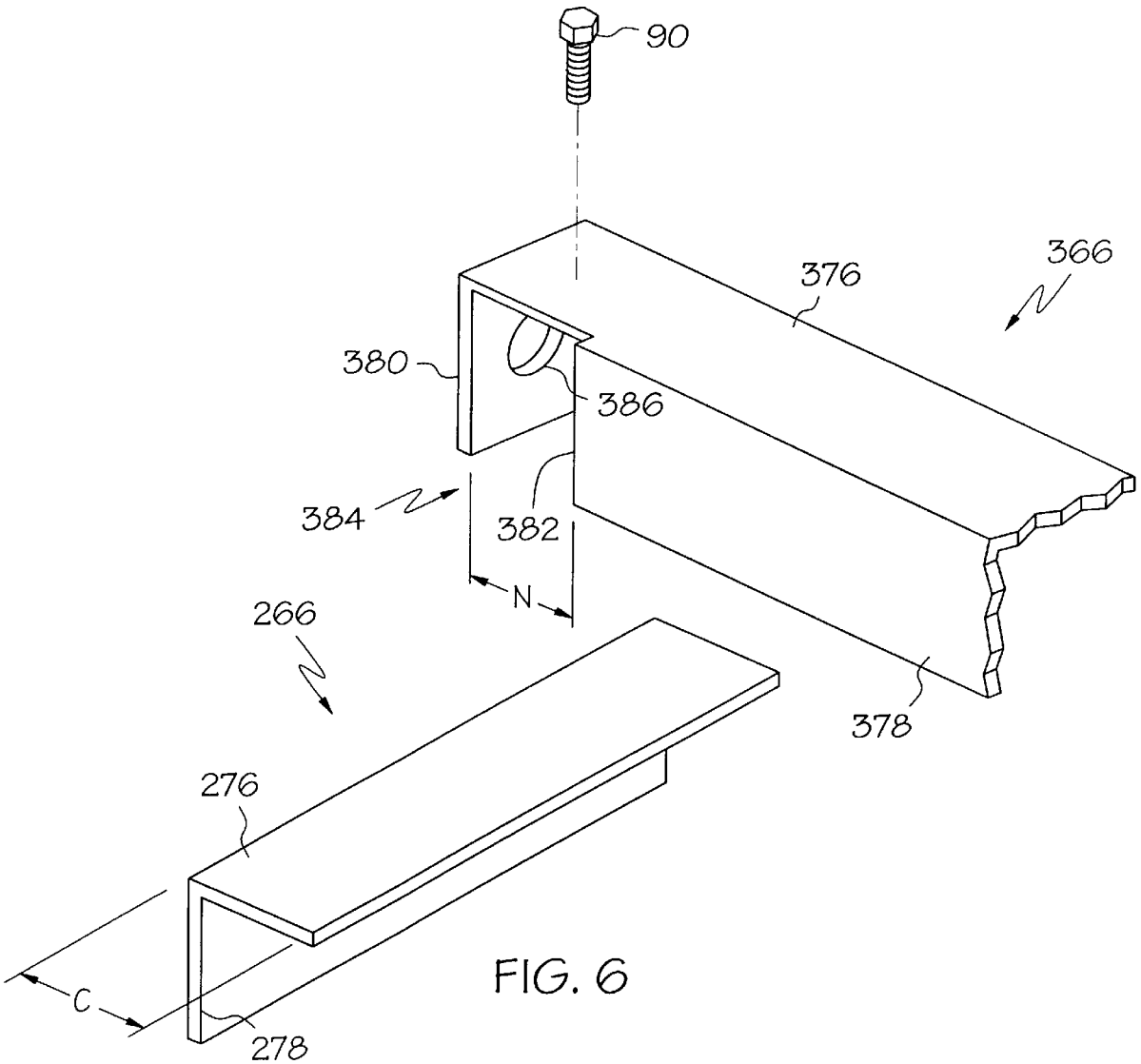
FIG. 6, is an enlarged, exploded, partial perspective view of an exemplary cross brace to cross brace configuration of the island form of FIG. 1.

Another preferred cross brace is illustrated in FIGS. 1 and 6 and is adapted to engage another cross brace 266 as well as wall member. Particularly, cross brace 366 has an end wall 380 which is offset a greater distance from the edge 382 of the side wall 378 such that a relatively larger notch 384 is provided than the notch 84 of a cross brace 66. More preferably, the notch 384 has a width N which is at least equal to the width C of the top wall 276 of the cross brace 266 so that the top wall 276 of the cross brace 266 can bottom against the top wall 376 of the cross brace 366, as shown in FIG. 1. A self tapping screw 90 passing through the top walls 76 of the cross braces 266 and 366 can be used to secure the cross braces to each other. Alternatively, the -cross brace 366 can span multiple cross braces (e.g., 66 and 266) such that the top wall 276 of the cross brace 266 engages the notch 384 of the cross brace 366. Alternatively, a self tapping screw can be provided through the hole 386 of the cross brace 366 and into the side wall 278 of the cross brace 266 to secure the cross braces together.

The preferred island form 20 can be assembled by aligning the end sections 24 and 26 with the center section 22 so that the wall members 32 and 34 abut the wall members 28 and 30. The wall members are interconnected to form the joints 35 by passing the studs 50, which have been attached by welding or the like to the inner surfaces 40 of the wall members, through the apertures 54 of the links 52. The nuts 62 are threaded onto the studs 50 such that the links 52 compressingly engage the inner surfaces 40 of the wall members, thereby interconnecting and aligning the wall members with one another. If it is discovered that the form 20 is skewed or otherwise distorted, one or more joints 35 can be adjusted by increasing or decreasing the gaps 46 thereat to aid in aligning the form 20.

The supports 64 are attached at the desired locations along the inner surfaces 40 of the wall members by passing at least two studs 70 through the holes 72 of a support 64. The cross braces 66 installed by sliding the supports 64 into the notches 84 of the cross braces 66. The cross braces 66 can then be located at the desired locations within the form 20 for providing added rigidity to the form 20 or for supporting a fuel dispenser sump 68. The nuts 74 can next be tightened about the studs 72 to removably secure the supports 64 and the cross braces 66 against the inner surface 40 of a wall member. Alternatively, the supports 66 can directly engage the studs 70, as previously discussed.

As will be appreciated, the above-described preferred joints and support and cross brace configurations made in accordance with the present invention can eliminate a substantial amount of welding along the length of the wall members of an island form which had been previously associated with attaching angle iron to the wall members while still providing flexibility in the placement of the cross braces as well as adjustable joints. This, in turn, can reduce the amount of distortion which would typically occur in such wall members from this welding.

Having shown and described the preferred embodiments of the present invention, further adaptions of the island forms described herein can be accomplished by appropriate modification by one of ordinary skill in the art without departing from the scope of the present invention. Several of such potential modifications have been mentioned, and others will be apparent to those skilled in the art. Accordingly, the scope of the present invention should be considered in terms of the following claims and is understood not be limited to the details of structure and operation shown and described in the specification and drawings.

What is claimed is:

1. A form for receiving a filler material to create an island, comprising:

a substantially continuous wall having an outer surface and an inner surface, the inner surface forming an enclosed chamber for receiving a filler material, the wall having a first side and a second side opposite the first side, and comprising a first wall member and a second wall member, the first wall member and the second wall member being connected at first ends by a first joint and at second ends by a second joint, wherein the joints are adjustable to securely connect the adjacent ends in a spaced relationship and further wherein the joints are adjustable to securely connect the adjacent ends in a contacting relationship;

a first support removably attached to the inner surface of the first side of said wall and a second support removably attached to the inner surface of the second side of the wall; and a brace disposed between the supports, the brace removably engaging the supports.

2. The form of claim 1, further comprising a first link spanning the first joint and a second link spanning the second joint, the links interconnecting the first and second wall members.

3. The form of claim 2, wherein the links are provided in the form of a substantially flat plate.

4. The form of claim 2, further comprising a plurality of first studs attached to the inner surface of the wall adjacent the joints, the first studs extending radially inwardly from the inner surface, the links comprising a plurality of apertures and the first studs passing through the apertures, the first studs threadably engaging a plurality of nuts to secure the links to the first and second wall members.

5. The form of claim 4, wherein the apertures are provided in the form of slots.

6. The form of claim 1, wherein said supports secure the braces at a predetermined position without a fastener interconnecting the braces and the supports.

7. The form of claim 6, wherein the braces further comprise at least one notch which engages the support.

8. The form of claim 4, wherein the wall further comprises a plurality of second studs attached to the inner surface of the wall, the second studs extending radially inwardly from the inner surface, the supports engaging at least some of the second studs to retain the braces at the predetermined positions, the braces being disposed between the second studs.

9. The form of claim 1, wherein the substantially continuous wall comprises four wall members, the wall members being connected at adjacent ends with joints, wherein the joints are adjustable to securely connect the adjacent ends in a spaced relationship and further wherein the joints are adjustable to securely connect the adjacent ends in a contacting relationship.

10. A form for receiving a filler material to create an island, comprising:

a substantially continuous wall having an outer surface and an inner surface, the inner surface forming a chamber for receiving the filler material, the wall having a first side and a second side opposite the first side, and comprising a first wall member and a second wall member, the first wall member and the second wall member being connected at first ends by a first joint and at second ends by a second joint, wherein the joints are adjustable to securely connect the adjacent ends in a spaced relationship and further wherein the joints are adjustable to securely connect the adjacent ends in a contacting relationship;

a plurality of first studs attached to the inner surface of the wall, the first studs extending radially inwardly from the inner surface of the wall; and a plurality of braces disposed between the first side and the second side, at least one of the plurality of braces removably engaging a first portion of the first studs.

11. The form of claim 10, wherein at least two of the braces support a sump.

12. The form of claim 10, further comprising a first link spanning the first joint and a second link spanning the second joint, the links interconnecting the first and second wall members.

13. The form of claim 12, wherein the links are provided in the form of a substantially flat plate.

14. A method for manufacturing an island form, comprising the steps of:

joining a first wall member and a second wall member to form a substantially continuous wall having an outer surface and an inner surface, the inner surface forming a chamber for receiving a filler material, the wall having a first side and a second side opposite the first side, the first wall member and the second wall member being connected at first ends by a first joint and at second ends by a second joint, wherein the joints are adjustable to securely connect the adjacent ends in a spaced relationship and further wherein the joints are adjustable to securely connect the adjacent ends in a contacting relationship;

attaching a plurality of first studs to the inner surface of the wall adjacent the joints, the first studs extending radially inwardly from the inner surface;

providing a first support and a second support;

removably attaching the first support to the inner surface of the first side of the wall and removably attaching the second support to the inner surface of the second side of the wall, the supports being attached by engaging at least some of the first studs; and providing a pair of braces between the first side and the second side of the wall; the braces engaging the first and second supports.

15. The method of claim 14, wherein the first studs are attached by welding.

16. A form for receiving a filler material to create an island, comprising:

a substantially continuous wall having an outer surface and an inner surface, the inner surface forming a chamber for receiving the filler material, the wall having a first side and a second side opposite the first side, and comprising a first wall member and a second wall member, the first wall member and the second wall member being connected at first ends by a first joint and at second ends by a second joint, wherein the joints are adjustable to securely connect the adjacent ends in a spaced relationship and further wherein the joints are adjustable to securely connect the adjacent ends in a contacting relationship;

a plurality of first studs attached to the inner surface of the wall, the first studs extending radially inwardly from the inner surface of the wall;

a plurality of braces disposed between the first side and the second side, at least one of the plurality of braces removably engaging a first portion of the first studs; and a first link spanning the first joint and a second link spanning the second joint, the links interconnecting the first and second wall members, the links comprising a plurality of apertures, wherein a second portion of the first studs pass through the apertures and threadably engage a plurality of nuts to secure the links to the first and second wall members.

17. The form of claim 16, further comprising a first support removably attached to the inner surface of the first side of the wall and a second support removably attached to the inner surface of the second side of the wall, the braces being adapted to removably engage both the first studs and the supports.

18. The form of claim 17, wherein the supports secure the braces at a predetermined position without a fastener interconnecting the braces and the supports.

19. A method for manufacturing an island form, comprising the steps of:

joining first, second, third and fourth wall members to form a substantially continuous wall having an outer surface and an inner surface, the inner surface forming a chamber for receiving a filler material, the wall having a first side and a second side opposite the first side, the wall members being connected at adjacent ends with joints, wherein the joints are adjustable to securely connect the adjacent ends in a spaced relationship and further wherein the joints are adjustable to securely connect the adjacent ends in a contacting relationship;

attaching a plurality of first studs to the inner surface of the wall adjacent the joints, the first studs extending radially inwardly from the inner surface;

providing a first support and a second support;

removably attaching the first support to the inner surface of the first side of the wall and removably attaching the second support to the inner surface of the second side of the wall, the supports being attached by engaging at least some of the first studs; and providing a pair of braces between the first side and the second side of the wall; the braces engaging the first and second supports.

* * * * *